US011777229B2

(12) United States Patent
Li et al.

(10) Patent No.: US 11,777,229 B2
(45) Date of Patent: Oct. 3, 2023

(54) ANTENNAS INCLUDING MULTI-RESONANCE CROSS-DIPOLE RADIATING ELEMENTS AND RELATED RADIATING ELEMENTS

(71) Applicant: CommScope Technologies LLC, Hickory, NC (US)

(72) Inventors: Yunzhe Li, Suzhou (CN); Gangyi Deng, Allen, TX (US); Peter J. Bisiules, La Grange Park, IL (US); YueMin Li, Suzhou (CN); Mohammad Vatankhah Varnoosfaderani, Richardson, TX (US); Chengcheng Tang, Murphy, TX (US)

(73) Assignee: CommScope Technologies LLC, Hickory, NC (US)

( * ) Notice: Subject to any disclaimer, the term of this patent is extended or adjusted under 35 U.S.C. 154(b) by 934 days.

(21) Appl. No.: 16/656,858

(22) Filed: Oct. 18, 2019

(65) Prior Publication Data

US 2020/0127389 A1 Apr. 23, 2020

Related U.S. Application Data

(60) Provisional application No. 62/797,667, filed on Jan. 28, 2019, provisional application No. 62/749,167, filed on Oct. 23, 2018.

(51) Int. Cl.

| | |
|---|---|
| ***H01Q 21/26*** | (2006.01) |
| ***H01Q 5/307*** | (2015.01) |
| ***H01Q 9/28*** | (2006.01) |

(52) U.S. Cl.

CPC ..... *H01Q 21/26* (2013.01); *H01Q 5/307* (2015.01); *H01Q 9/28* (2013.01)

(58) Field of Classification Search

CPC ..... H01Q 21/26; H01Q 5/307; H01Q 9/28

See application file for complete search history.

(56) References Cited

U.S. PATENT DOCUMENTS 6,342,866 B1 1/2002 Ho et al.
9,172,147 B1 * 10/2015 Manry, Jr. ..... H01Q 1/286

(Continued)

FOREIGN PATENT DOCUMENTS

CN 102683853 A * 9/2012
CN 202839949 U 3/2013

(Continued)

OTHER PUBLICATIONS

"International Preliminary Report on Patentability; Written Opinion of the International Searching Authority, corresponding to International Application No. PCT/US2019/056844, dated Apr. 27, 2021, 14 pages".

(Continued)

*Primary Examiner* — Dieu Hien T Duong
(74) *Attorney, Agent, or Firm* — Myers Bigel, P.A.

(57) ABSTRACT

Radiating elements include a first dipole radiator that extends along a first axis, the first dipole radiator including a first pair of dipole arms that are configured to resonate at a first frequency and a second pair of dipole arms that are configured to resonate at a second frequency that is different than the first frequency. Each dipole arm in the first pair of dipole arms comprises a plurality of widened sections that are connected by intervening narrowed sections.

14 Claims, 9 Drawing Sheets

(56) References Cited

U.S. PATENT DOCUMENTS

| | | | | |
|---|---|---|---|---|
| 10,439,285 | B2 | 10/2019 | Isik et al. | |
| 10,547,110 | B1 | 1/2020 | Isik et al. | |
| 2011/0298682 | A1 | 12/2011 | Plet et al. | |
| 2015/0070234 | A1* | 3/2015 | Jones | H01Q 21/28 343/797 |
| 2016/0172764 | A1 | 6/2016 | Lin et al. | |
| 2016/0301136 | A1* | 10/2016 | Jan | H01Q 5/371 |
| 2016/0352019 | A1* | 12/2016 | Hsu | H01Q 9/285 |
| 2017/0294704 | A1 | 10/2017 | Sun et al. | |
| 2017/0310009 | A1 | 10/2017 | Isik et al. | |
| 2018/0323513 | A1 | 11/2018 | Varnoosfaderani et al. | |
| 2019/0115664 | A1 | 4/2019 | Veihl et al. | |

FOREIGN PATENT DOCUMENTS

| | | | |
|---|---|---|---|
| CN | 103840254 | A | 6/2014 |
| CN | 103947041 | A | 7/2014 |
| CN | 104143699 | A | 11/2014 |
| CN | 105281031 | A | 1/2016 |
| CN | 105449361 | A | 3/2016 |
| CN | 106848603 | A | 6/2017 |
| CN | 107078390 | A | 8/2017 |
| CN | 208753520 | U | 4/2019 |
| JP | 2001185938 | A | 7/2001 |

OTHER PUBLICATIONS

"English Translation of Office Action for the First Office Action for corresponding Chinese Application No. 201980070038.7, dated Aug. 3, 2023, 13 pages ".

* cited by examiner

ANTENNAS INCLUDING MULTI-RESONANCE CROSS-DIPOLE RADIATING ELEMENTS AND RELATED RADIATING ELEMENTS

CROSS-REFERENCE TO RELATED APPLICATIONS

The present application claims priority to U.S. Provisional Patent Application Ser. No. 62/797,667, filed Jan. 28, 1019, and to U.S. Provisional Patent Application Ser. No. 62/749,167, filed Oct. 23, 2018, the entire content of each of which is incorporated by reference herein.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells" which are served by respective base stations. The base station may include one or more antennas that are configured to provide two-way radio frequency ("RF") communications with mobile subscribers that are within the cell served by the base station. In many cases, each base station is divided into "sectors." In one common configuration, a hexagonally shaped cell is divided into three 120° sectors in the azimuth plane, and each sector is served by one or more base station antennas that have an azimuth Half Power Beamwidth ("HPBW") of approximately 65° to provide coverage to the full 120° sector. Typically, the base station antennas are mounted on a tower or other raised structure, with the radiation patterns (also referred to herein as "antenna beams") that are generated by the base station antennas directed outwardly. Base station antennas are often implemented as linear or planar phased arrays of radiating elements.

In order to accommodate the increasing volume of cellular communications, cellular operators have added cellular service in a variety of new frequency bands. While in some cases it is possible to use a single linear array of so-called "wide-band" radiating elements to provide service in multiple frequency bands, in other cases it is necessary to use different linear arrays (or planar arrays) of radiating elements to support service in the different frequency bands.

As the number of frequency bands has proliferated, and increased sectorization has become more common (e.g., dividing a cell into six, nine or even twelve sectors), the number of base station antennas deployed at a typical base station has increased significantly. However, due to, for example, local zoning ordinances and/or weight and wind loading constraints for the antenna towers, there is often a limit as to the number of base station antennas that can be deployed at a given base station. In order to increase capacity without further increasing the number of base station antennas, so-called multi-band base station antennas have been introduced which include multiple arrays of radiating elements. One common multi-band base station antenna design includes one linear array of "low-band" radiating elements that are used to provide service in some or all of the 694-960 MHz frequency band and two linear arrays of "mid-band" radiating elements that are used to provide service in some or all of the 1427-2690 MHz frequency band. These linear arrays are mounted in side-by-side fashion. Another known multi-band base station antenna includes two linear arrays of low-band radiating elements and two linear arrays of mid-band radiating elements. There is also interest in deploying base station antennas that further include one or more linear arrays of "high-band" radiating elements that operate in higher frequency bands, such as the 3.3-4.2 GHz frequency band.

SUMMARY

Pursuant to embodiments of the present invention, radiating elements are provided that include a first dipole radiator that extends along a first axis, the first dipole radiator including a first pair of dipole arms that are configured to resonate at a first frequency and a second pair of dipole arms that are configured to resonate at a second frequency that is different than the first frequency. Each dipole arm in the first pair of dipole arms comprises a plurality of widened sections that are connected by intervening narrowed sections.

In some embodiments, the radiating element may further include a second dipole radiator that extends along a second axis, the second dipole radiator including a third pair of dipole arms that are configured to resonate at the first frequency and a fourth pair of dipole arms that are configured to resonate at the second frequency. In such embodiments, each dipole arm in the third pair of dipole arms may comprise a plurality of widened sections that are connected by intervening narrowed sections. In some embodiments, each dipole arm in the second pair of dipole arms and each dipole arm in the fourth pair of dipole arms may comprise a plurality of widened sections that are connected by intervening narrowed sections.

In some embodiments, each of the dipole arms in the first pair of dipole arms includes more widened sections than do each of the dipole arms in the second pair of dipole arms.

In some embodiments, the radiating element may include a dipole printed circuit board, the first pair of dipole arms may comprise a metal pattern on a first layer of the dipole printed circuit board and the second pair of dipole arms may comprise a metal pattern on a second layer of the dipole printed circuit board. In such embodiments, the radiating element may further include at least one feed stalk that extends generally perpendicular to a plane defined by the first dipole radiator, and the first pair of dipole arms may be center-fed from a common RF transmission line.

In some embodiments, at least some of the narrowed sections may comprise meandered conductive traces.

In some embodiments, an electrical length of the second pair of dipole arms may be less than an electrical length of the first pair of dipole arms.

In some embodiments, the second pair of dipole arms may be capacitively coupled to the first pair of dipole arms.

In some embodiments, a plurality of conductive vias may electrically connect the second pair of dipole arms to the first pair of dipole arms.

In some embodiments, each dipole arm in the first pair of dipole arms may include first and second spaced-apart conductive segments that together form a generally oval shape.

In some embodiments, the first frequency and the second frequency may both be within an operating frequency band of the radiating element. In some embodiments, the first frequency may be below a center frequency of the operating frequency band of the radiating element and the second frequency may be above the center frequency of the operating frequency band of the radiating element.

In some embodiments, the first dipole radiator may further include a third pair of dipole arms that are configured to resonate at a third frequency that is different than the first and second frequencies. In such embodiments, the radiating element may include a dipole printed circuit board, the first pair of dipole arms may comprise a metal pattern on a first layer of the dipole printed circuit board, the second pair of dipole arms may comprise a metal pattern on a second layer of the dipole printed circuit board and the third pair of dipole arms may comprise a metal pattern on a third layer of the dipole printed circuit board.

Any of the above-described radiating elements may be mounted on a base station antenna as part of a first linear array of radiating elements that are configured to transmit RF signals in a first operating frequency band. In some embodiments, the base station antenna may further include a second linear array of radiating elements that are configured to transmit RF signals in a second operating frequency band. In such embodiments, at least one of the dipole arms in the first pair of dipole arms may horizontally overlap one of the radiating elements in the second linear array of radiating elements. Additionally or alternatively, in some embodiments, the first dipole radiator may be configured to transmit radio frequency ("RF") signals in the first operating frequency band and to be substantially transparent to RF signals in the second operating frequency band.

In some embodiments, the radiating element may include an insulating substrate and the first pair of dipole arms may comprise one or more metal patterns that are attached to a front side of the insulating substrate and the second pair of dipole arms may comprise one or more metal patterns that are attached to a rear side of the insulating substrate.

In some embodiments, each dipole arm in the second pair of dipole arms may comprise a plurality of widened sections. In some embodiments, at least one conductive via may electrically connect each widened section in each dipole arm in the second pair of dipole arms to a respective portion of a corresponding one of the dipole arms in the first pair of dipole arms. In some embodiments, the widened sections in each dipole arm in the second pair of dipole arms may only electrically connect to each other through one of the dipole arms in the first pair of dipole arms.

In some embodiments, at least two of the widened sections in at least one of the dipole arms in the first pair of dipole arms may only electrically connect to each other through an intervening narrowed section that is part of one of the dipole arms in the second pair of dipole arms. In some embodiments, at least two of the widened sections in at least one of the dipole arms in the second pair of dipole arms may only electrically connect to each other through an intervening narrowed section that is part of one of the dipole arms in the first pair of dipole arms.

Pursuant to further embodiments of the present invention, radiating elements are provided that include a feed stalk printed circuit board and a dipole printed circuit board mounted on the feed stalk printed circuit board. The dipole printed circuit board includes a first dipole radiator that includes a first pair of dipole arms that are configured to resonate at a first frequency and a second pair of dipole arms that are configured to resonate at a second frequency that is different than the first frequency. The first pair of dipole arms comprises a metal pattern on a first layer of the dipole printed circuit board and the second pair of dipole arms comprises a metal pattern on a second layer of the dipole printed circuit board.

In some embodiments, the dipole printed circuit board may further include a second dipole radiator that includes a third pair of dipole arms that are configured to resonate at the first frequency and a fourth pair of dipole arms that are configured to resonate at the second frequency, and the third pair of dipole arms may comprise part of the metal pattern on the first layer of the dipole printed circuit board and the fourth pair of dipole arms may comprise part of the metal pattern on the second layer of the dipole printed circuit board.

In some embodiments, each dipole arm in the first and second pairs of dipole arms may comprise a plurality of widened sections that are connected by intervening narrowed sections.

In some embodiments, each dipole arm in the first pair of dipole arms may include first and second spaced-apart conductive segments that together form a generally oval shape.

In some embodiments, each dipole arm in the first pair of dipole arms may include more widened sections than does each dipole arm in the second pair of dipole arms.

In some embodiments, the first frequency and the second frequency may be within an operating frequency band of the radiating element. In some embodiments, the first frequency may be below a center frequency of the operating frequency band of the radiating element and the second frequency may be above the center frequency of the operating frequency band of the radiating element.

In some embodiments, the first dipole radiator may further include a third pair of dipole arms that are configured to resonate at a third frequency that is different than the first and second frequencies.

In some embodiments, a first plurality of conductive vias may electrically connect the second pair of dipole arms to the first pair of dipole arms.

Any of the above-described radiating elements may mounted on a base station antenna as part of a first linear array of radiating elements that are configured to transmit RF signals in a first operating frequency band, and the base station antenna may also include a second linear array of radiating elements that are configured to transmit RF signals in a second operating frequency band. In some embodiments, at least one of the dipole arms in the first pair of dipole arms may horizontally overlap one of the radiating elements in the second linear array of radiating elements.

Pursuant to still further embodiments of the present invention, radiating elements are provided that include a first dipole radiator that extends along a first axis. The first dipole radiator has a first pair of dipole arms that have a first electrical length and a second pair of dipole arms that have a second electrical length that is different than the first electrical length. The first pair of dipole arms stacked on top of the second pair of dipole arms and separated from the second pair of dipole arms by a dielectric layer. The first pair of dipole arms are galvanically coupled to the second pair of dipole arms.

In some embodiments, the first pair of dipole arms may be configured to resonate at a first frequency and the second pair of dipole arms may be configured to resonate at a second frequency that is different than the first frequency, the first and second frequencies being within an operating frequency band of the radiating element.

In some embodiments, the first frequency may be below a center frequency of the operating frequency band of the radiating element and the second frequency may be above the center frequency of the operating frequency band of the radiating element.

In some embodiments, the radiating element may include a printed circuit board, the first pair of dipole arms may comprise a metal pattern on a first layer of the printed circuit board and the second pair of dipole arms may comprise a metal pattern on a second layer of the printed circuit board.

In some embodiments, at least some of the dipole arms in the first and second pairs of dipole arms may comprise a plurality of widened sections that are connected by intervening narrowed sections.

In some embodiments, each dipole arm in the first pair of dipole arms may include more widened sections than does each dipole arm in the second pair of dipole arms.

In some embodiments, at least some of the narrowed sections may comprise meandered conductive traces.

In some embodiments, a first plurality of conductive vias may electrically connect the second pair of dipole arms to the first pair of dipole arms.

In some embodiment, the radiating element may be mounted on a base station antenna as part of a first linear array of radiating elements that are configured to transmit RF signals in a first operating frequency band, and the base station antenna may further include a second linear array of radiating elements that are configured to transmit RF signals in a second operating frequency band. In some embodiments, the first dipole radiator may be configured to be substantially transparent to RF signals in a second frequency band. In some embodiments, at least one of the dipole arms in the first pair of dipole arms may horizontally overlap one of the radiating elements in the second linear array of radiating elements.

DETAILED DESCRIPTION

Figure 1:
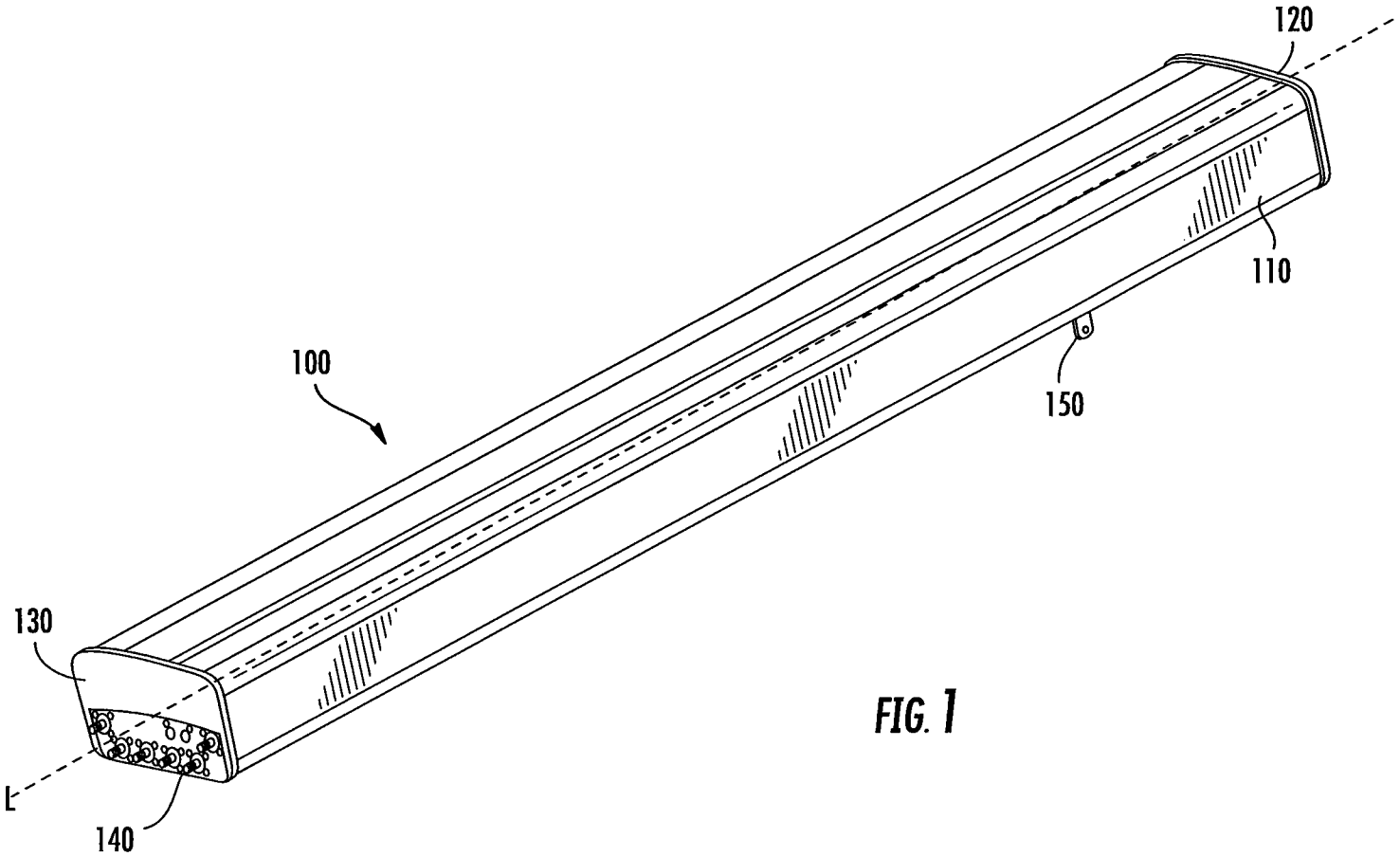
FIG. 1 is a perspective view of a base station antenna according to embodiments of the present invention.

Embodiments of the present invention relate generally to radiating elements for a multi-band base station antenna and to related base station antennas. The multi-band base station antennas according to embodiments of the present invention may support two or more major air-interface standards in two or more cellular frequency bands and allow wireless operators to reduce the number of antennas deployed at base stations, lowering tower leasing costs while increasing speed to market capability.

A challenge in the design of multi-band base station antennas is reducing the effect of scattering of the RF signals at one frequency band by the radiating elements of other frequency bands. Scattering is undesirable as it may affect the shape of the antenna beam in both the azimuth and elevation planes, and the effects may vary significantly with frequency, which may make it hard to compensate for these effects. Moreover, at least in the azimuth plane, scattering tends to impact one or more of the beamwidth, beam shape, pointing angle, gain and front-to-back ratio in undesirable ways.

In order to reduce scattering, broadband decoupling radiating elements have been developed that may transmit and receive RF signals in a first frequency band while being substantially transparent to RF signals in a second frequency band. For example, U.S. Provisional Patent Application Ser. No. 62/500,607, filed May 3, 2017, discloses a multi-band antenna that includes linear arrays of both low-band and mid-band cross-dipole radiating elements. The low-band cross-dipole radiating elements have dipole arms that each include a plurality of widened sections that are connected by intervening narrowed sections. The narrowed trace sections may be designed to act as high impedance sections that are designed to interrupt currents in the operating frequency band of the mid-band radiating elements that could otherwise be induced on dipole arms of the low-band radiating elements. The narrowed trace sections may be designed to create this high impedance for currents in the operating frequency band of the mid-band radiating elements without significantly impacting the ability of the low-band currents to flow on the dipole arms. As a result, the low-band radiating elements may be substantially transparent to the mid-band radiating elements, and hence may have little or no impact on the antenna beams formed by the mid-band radiating elements. The narrowed sections may act like inductive sections. In fact, in some embodiments, the narrowed trace sections may be replaced with lumped inductances such as chip inductors, coils and the like or other printed circuit board structures (e.g., solenoids) that act like inductors. The narrowed trace sections (or other inductive elements), however, may increase the impedance of the low-band dipole radiators, which may reduce the operating bandwidth of the low-band radiating elements.

Pursuant to embodiments of the present invention, multi-resonance dipole radiating elements are provided that may exhibit increased operating bandwidth as compared to conventional dipole radiating elements. Each dipole radiator in these radiating elements may include two (or more) pairs of dipole arms, where each pair of dipole arms is configured to resonate at a different frequency. By designing the dipole radiators to radiate at two or more different resonant frequencies, the operating bandwidth for the radiating element may be increased. For example, a multi-resonance dipole radiating element according to embodiments of the present invention that is configured to operate in a frequency band having a center frequency of $f_c$ may be designed so that one pair of dipole arms radiates at a frequency within the operating frequency band that is below $f_c$, while another one of the dipole arm pairs radiates at a frequency within the operating frequency band that is above $f_c$. The result is that the operating bandwidth of the multi-resonance dipole radiating element may be increased as compared to a single resonance dipole radiating element. These radiating elements may be used, for example, in multi-band antennas, and may be particularly useful in multi-band antennas that include radiating elements that are designed to pass currents in a first frequency band while being substantially transparent to currents in a second frequency band.

In some embodiments, the radiating elements may include a first dipole radiator that extends along a first axis, the first dipole radiator including a first pair of dipole arms that are configured to resonate at a first frequency, and a second pair of dipole arms that are configured to resonate at a second frequency that is different than the first frequency. In such embodiments, each dipole arm in the first pair of dipole arms may comprise a plurality of widened sections that are connected by intervening narrowed sections.

In other embodiments, the radiating elements may include a feed stalk printed circuit board and a dipole printed circuit board that is mounted on the feed stalk printed circuit board. The dipole printed circuit board may include a first dipole radiator that includes a first pair of dipole arms that are configured to resonate at a first frequency and a second pair of dipole arms that are configured to resonate at a second frequency that is different than the first frequency. The first pair of dipole arms may comprise a metal pattern on a first layer of the dipole printed circuit board and the second pair of dipole arms may comprise a metal pattern on a second layer of the dipole printed circuit board.

In still other embodiments, the radiating elements may include a first dipole radiator that extends along a first axis, the first dipole radiator including a first pair of dipole arms that have a first electrical length and a second pair of dipole arms that have a second electrical length that is different than the first electrical length. The first pair of dipole arms may be stacked on top of the second pair of dipole arms and separated from the second pair of dipole arms by a dielectric layer, and the first pair of dipole arms may be galvanically coupled to the second pair of dipole arms. In embodiments where the first and second pairs of dipole arms are implemented as first and second metallization layers on a dipole printed circuit board, the first pair of dipole arms may be galvanically connected to the second pair of dipole arms using plated through holes that electrically connect the first and second metallization layers of the dipole printed circuit board.

In some embodiments of the various radiating elements described above, the first and second pairs of dipole arms may be capacitively coupled to one another. In other embodiments direct galvanic connections may be provided. Additionally, while the above embodiments are described as having first and second pairs of dipole arms that resonate at respective first and second frequencies, it will be appreciated that the radiating elements may include one or more additional pairs of dipole arms that resonate at yet additional respective frequencies.

Embodiments of the present invention will now be described in further detail with reference to the attached figures.

Figure 2:
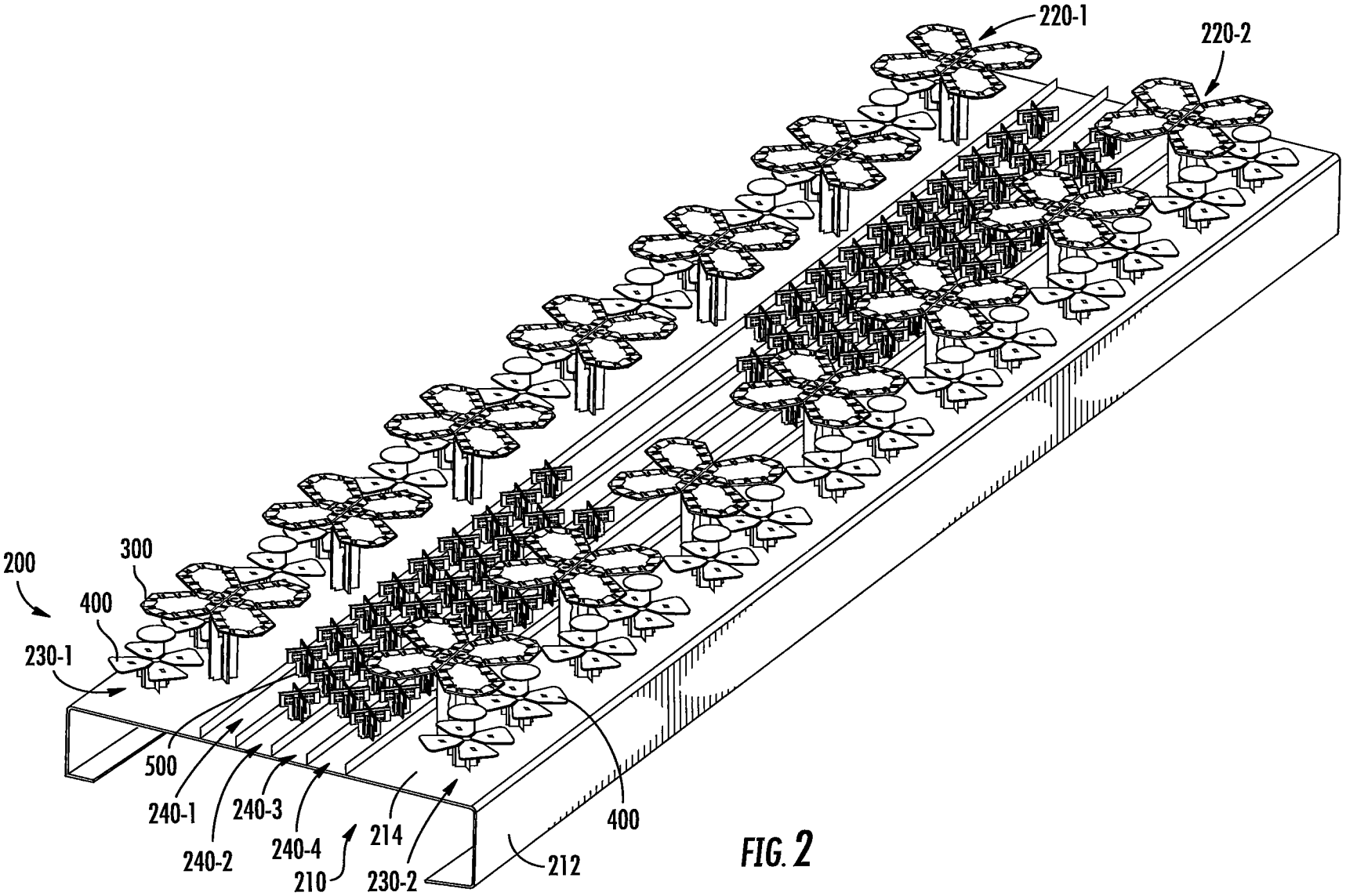
FIG. 2 is a perspective view of the base station antenna of FIG. 1 with the radome removed.
Figure 3:
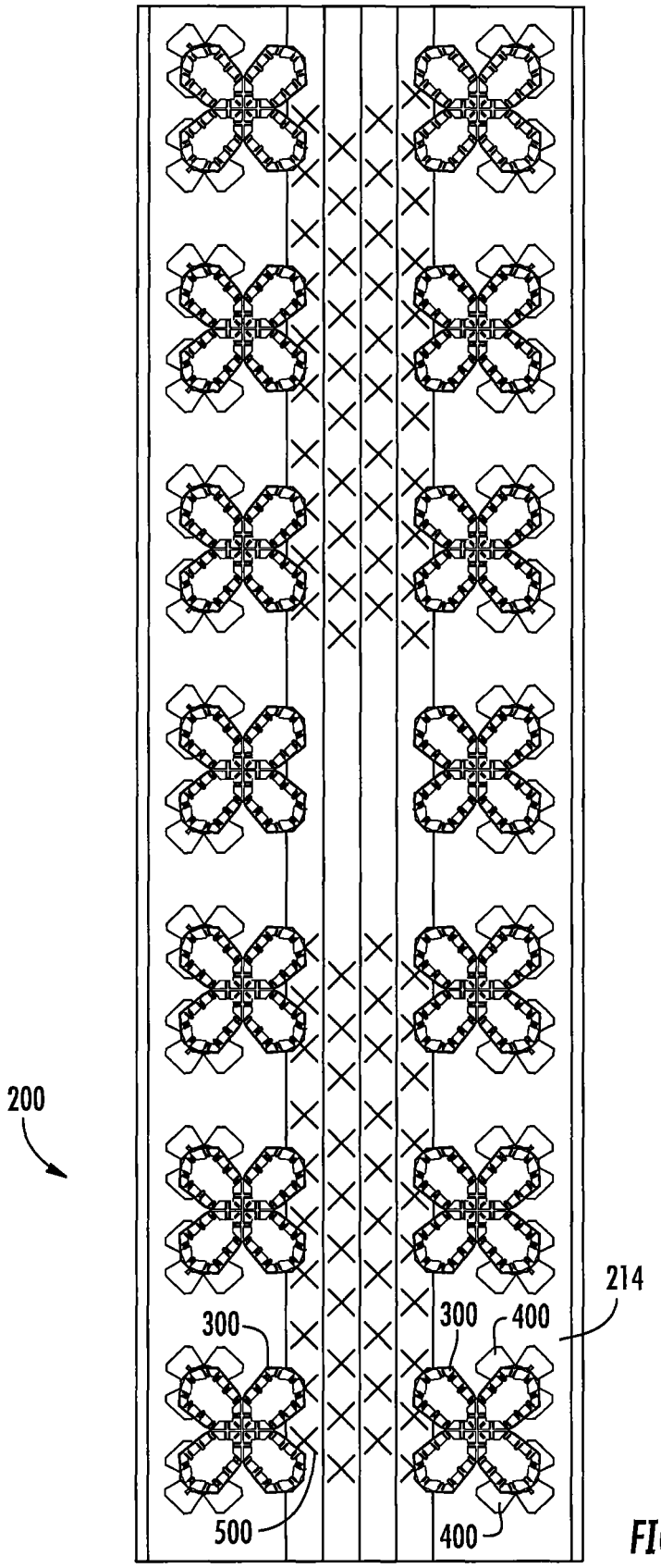
FIG. 3 is a front view of the base station antenna of FIG. 1 with the radome removed.
Figure 4:
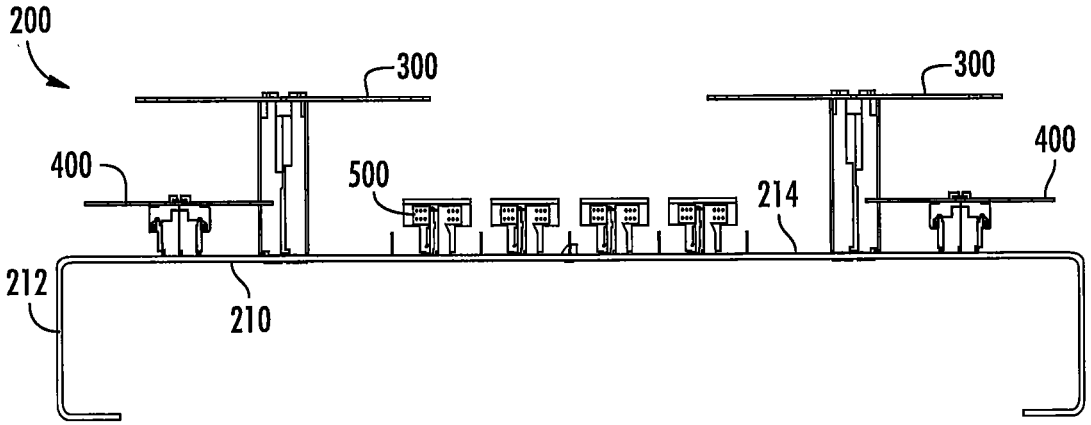
FIG. 4 is a cross-sectional view of the base station antenna of FIG. 1 with the radome removed.
Figure 5:
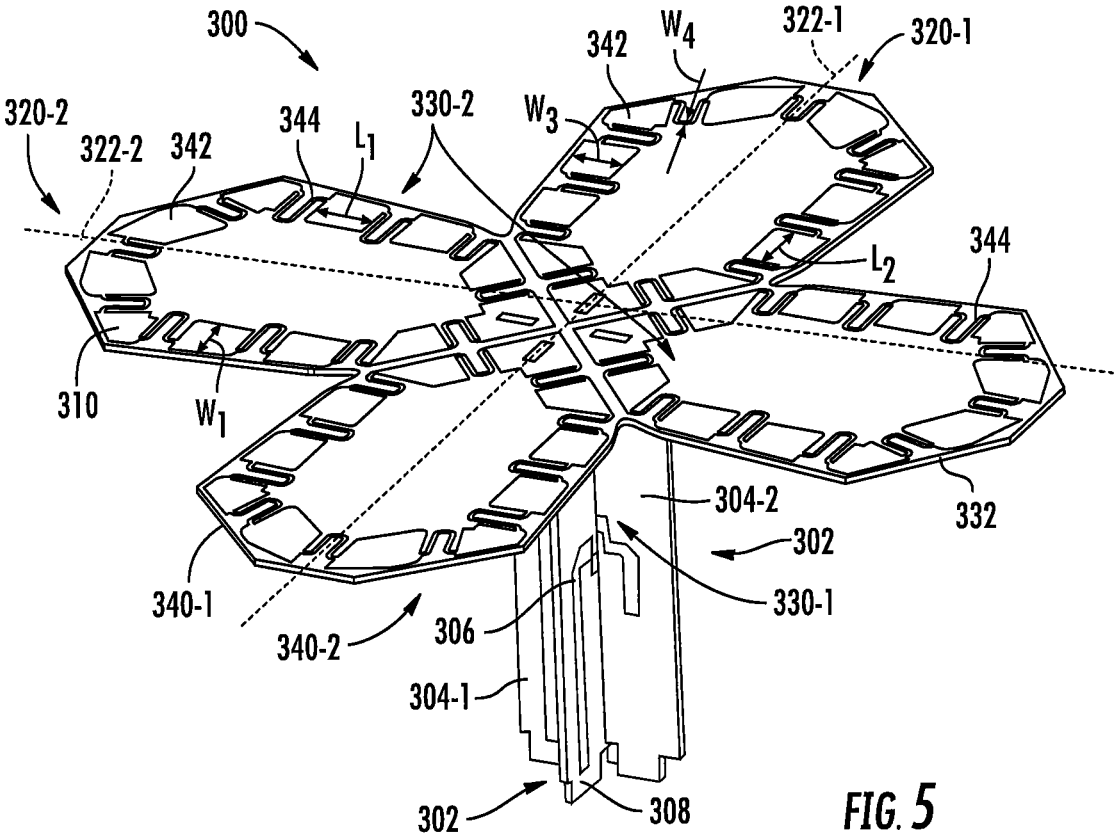
FIG. 5 is an enlarged perspective view of one of the low-band radiating elements of the base station antenna of FIGS. 1-4.
Figure 6:
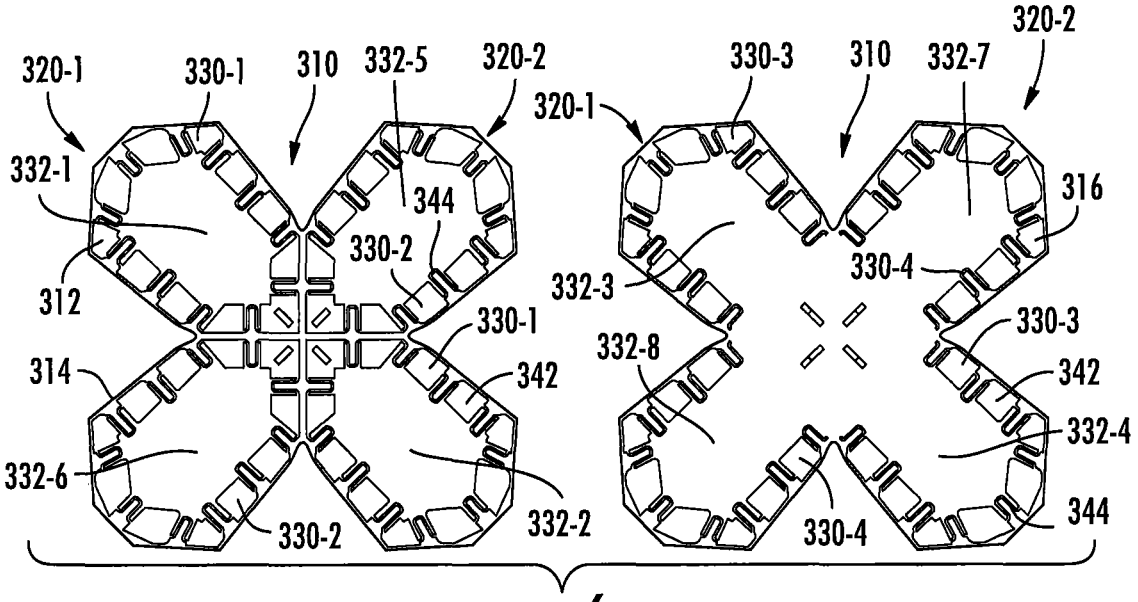
FIG. 6 shows front and back views of the dipole printed circuit board of one of the low-band radiating elements of the base station antenna of FIGS. 1-4.

FIGS. 1-4 illustrate a base station antenna 100 according to certain embodiments of the present invention. In particular, FIG. 1 is a perspective view of the antenna 100, while FIGS. 2-4 are perspective, front and cross-sectional views, respectively, of the antenna 100 with the radome thereof removed to illustrate the antenna assembly 200 of the antenna 100. FIG. 5 is a perspective view of one of the low-band radiating elements included in the base station antenna 100, while FIG. 6 is a front and back view of the dipole printed circuit board of one of the low-band radiating elements of base station antenna of 100.

As shown in FIGS. 1-4, the base station antenna 100 is an elongated structure that extends along a longitudinal axis L. The base station antenna 100 may have a tubular shape with a generally rectangular cross-section. The antenna 100 includes a radome 110 and a top end cap 120. In some embodiments, the radome 110 and the top end cap 120 may comprise a single integral unit, which may be helpful for waterproofing the antenna 100. One or more mounting brackets 150 are provided on the rear side of the antenna 100 which may be used to mount the antenna 100 onto an antenna mount (not shown) on, for example, an antenna tower. The antenna 100 also includes a bottom end cap 130 which includes a plurality of connectors 140 mounted therein. The antenna 100 is typically mounted in a vertical configuration (i.e., the longitudinal axis L may be generally perpendicular to a plane defined by the horizon) when the antenna 100 is mounted for normal operation. The radome 110, top cap 120 and bottom cap 130 may form an external housing for the antenna 100. An antenna assembly 200 is contained within the housing. The antenna assembly 200 may be slidably inserted into the radome 110.

As shown in FIGS. 2-4, the antenna assembly 200 includes a ground plane structure 210 that has sidewalls 212 and a reflector surface 214. Various mechanical and electronic components of the antenna (not shown) may be mounted in the chamber defined between the sidewalls 212 and the back side of the reflector surface 214 such as, for example, phase shifters, remote electronic tilt units, mechanical linkages, a controller, diplexers, and the like. The reflector surface 214 of the ground plane structure 210 may comprise or include a metallic surface that serves as a reflector and ground plane for the radiating elements of the antenna 100. Herein the reflector surface 214 may also be referred to as the reflector 214.

A plurality of dual-polarized radiating elements 300, 400, 500 are mounted to extend forwardly from the reflector surface 214 of the ground plane structure 210. The radiating elements include low-band radiating elements 300, mid-band radiating elements 400 and high-band radiating elements 500. The low-band radiating elements 300 are mounted in two columns to form two linear arrays 220-1, 220-2 of low-band radiating elements 300. Each low-band linear array 220 may extend along substantially the full length of the antenna 100 in some embodiments. The mid-band radiating elements 400 may likewise be mounted in two columns to form two linear arrays 230-1, 230-2 of mid-band radiating elements 400. The high-band radiating elements 500 are mounted in four columns to form four linear arrays 240-1 through 240-4 of high-band radiating elements 500. In other embodiments, the number of linear arrays of low-band, mid-band and/or high-band radiating elements may be varied from those shown in FIGS. 2-4. For example, the linear arrays 230-1, 230-2 of mid-band radiating elements 400 could be omitted in other embodiments (and the ground plane structure 210 narrowed accordingly). It should be noted that herein like elements may be referred to individually by their full reference numeral (e.g., linear array 230-2) and may be referred to collectively by the first part of their reference numeral (e.g., the linear arrays 230).

In the depicted embodiment, the linear arrays 240 of high-band radiating elements 500 are positioned between the linear arrays 220 of low-band radiating elements 300, and each linear array 220 of low-band radiating elements 300 is positioned between a respective one of the linear arrays 240 of high-band radiating elements 500 and a respective one of the linear arrays 230 of mid-band radiating elements 400. The linear arrays 230 of mid-band radiating elements 400 may or may not extend the full length of the antenna 100, and the linear arrays 240 of high-band radiating elements 500 may or may not extend the full length of the antenna 100.

The low-band radiating elements 300 may be configured to transmit and receive signals in a first frequency band. In some embodiments, the first frequency band may comprise the 617-960 MHz frequency range or a portion thereof (e.g., the 617-806 MHz frequency band, the 694-960 MHz frequency band, etc.). The mid-band radiating elements 400 may be configured to transmit and receive signals in a second frequency band. In some embodiments, the second frequency band may comprise the 1427-2690 MHz frequency range or a portion thereof (e.g., the 1710-2200 MHz frequency band, the 2300-2690 MHz frequency band, etc.). The high-band radiating elements 500 may be configured to transmit and receive signals in a third frequency band. In some embodiments, the third frequency band may comprise the 3300-4200 MHz frequency range or a portion thereof. The two low-band linear arrays 220 may or may not be configured to transmit and receive signals in the same portion of the first frequency band. For example, in one embodiment, the low-band radiating elements 300 in the first linear array 220-1 may be configured to transmit and receive signals in the 700 MHz frequency band and the low-band radiating elements 300 in the second linear array 220-2 may be configured to transmit and receive signals in the 800 MHz frequency band. In other embodiments, the low-band radiating elements 300 in both the first and second linear arrays 220-1, 220-2 may be configured to transmit and receive signals in the 700 MHz (or 800 MHz) frequency band. The mid-band and high-band radiating elements 400, 500 in the different mid-band and high-band linear arrays 230, 240 may similarly have any suitable configuration. The low-band, mid-band and high-band radiating elements 300, 400, 500 may each be mounted to extend forwardly from the ground plane structure 210.

As noted above, the low-band radiating elements 300 are arranged as two low-band arrays 220 of dual-polarized radiating elements. Each low-band array 220-1, 220-2 may be used to form a pair of antenna beams, namely an antenna for each of the two polarizations at which the dual-polarized radiating elements 300 are designed to transmit and receive RF signals. Each radiating element 300 in the first low-band array 220-1 may be horizontally aligned with a respective radiating element 300 in the second low-band array 220-2. Likewise, each radiating element 400 in the first mid-band array 230-1 may be horizontally aligned with a respective radiating element 400 in the second mid-band array 230-2. While not shown in the figures, the radiating elements 300, 400, 500 may be mounted on feed boards that couple RF signals to and from the individual radiating elements 300, 400, 500. One or more radiating elements 300, 400, 500 may be mounted on each feed board. Cables may be used to connect each feed board to other components of the antenna such as diplexers, phase shifters or the like.

While cellular network operators are interested in deploying antennas that have a large number of linear arrays of radiating elements in order to reduce the number of base station antennas required per base station, increasing the number of linear arrays typically increases the width of the antenna. Both the weight of a base station antenna and the wind loading the antenna will experience increase with increasing width, and thus wider base station antennas tend to require structurally more robust antenna mounts and antenna towers, both of which can significantly increase the cost of a base station. Accordingly, cellular network operators typically want to limit the width of a base station antenna to be less than 500 mm, and more preferably, to less than 440 mm (or in some cases, less than 400 mm). This can be challenging in base station antennas that include two linear arrays of low-band radiating elements, since most conventional low-band radiating elements that are designed to serve a 120° sector have a width of about 200 mm or more.

The width of a multi-band base station antenna may be reduced by decreasing the separation between adjacent linear arrays. Thus, in antenna 100, the low-band radiating elements 300 may be located in very close proximity to both the mid-band radiating elements 400 and the high-band radiating elements 500. As can be seen in FIGS. 2-4, the low-band radiating elements 300 extend farther forwardly from the reflector 214 than do both the mid-band radiating elements 400 and the high-band radiating elements 500. In the depicted embodiment, each low-band radiating element 300 that is adjacent a linear array 230 of mid-band radiating elements 400 may horizontally overlap a substantial portion of two of the mid-band radiating elements 400. The term "horizontally overlap" is used herein to refer to a specific positional relationship between first and second radiating elements that extend forwardly from a reflector of a base station antenna. In particular, a first radiating element is considered to "horizontally overlap" a second radiating element if an imaginary line can be drawn that is normal to the top surface of the reflector that passes through both the first radiating element and the second radiating element. Likewise, each low-band radiating element 300 that is adjacent a linear array 240 of high-band radiating elements 500 may horizontally overlap at least a portion of one or more of the high-band radiating elements 500. Allowing the radiating elements to horizontally overlap allows for a significant reduction in the width of the base station antenna 100.

Unfortunately, when the separation between adjacent linear arrays is reduced, increased coupling between radiating elements of the linear arrays occurs, and this increased coupling may impact the shapes of the antenna beams generated by the linear arrays in undesirable ways. For example, a low-band cross-dipole radiating element will typically have dipole radiators that have a length that is approximately ½ a wavelength of the operating frequency. Each dipole radiator is typically implemented as a pair of center-fed dipole arms. If the low-band radiating element is designed to operate in the 700 MHz frequency band, and the mid-band radiating elements are designed to operate in the 1400 MHz frequency band, the length of the low-band dipole radiators will be approximately one wavelength at the mid-band operating frequency. As a result, each dipole arm of a low-band dipole radiator will have a length that is approximately ½ a wavelength at the mid-band operating frequency, and hence RF energy transmitted by the mid-band radiating elements will tend to couple to the low-band radiating elements. This coupling can distort the antenna pattern of the mid-band linear array. Similar distortion can occur if RF energy emitted by the high-band radiating elements couples to the low-band radiating elements.

Thus, while positioning the low-band radiating elements 300 so that they horizontally overlap the mid-band and/or the high-band radiating elements 400, 500 may advantageously facilitate reducing the width of the base station antenna 100, this approach may significantly increase the coupling of RF energy transmitted by the mid-band and/or the high-band radiating elements 400, 500 onto the low-band radiating elements 300, and such coupling may degrade the antenna patterns formed by the linear arrays 230, 240 of mid-band and/or high-band radiating elements 400, 500.

As discussed above, in order to reduce such coupling, the low-band radiating elements 300 may be configured to be substantially transparent to the mid-band radiating elements 400 or to the high-band radiating elements 500. FIG. 5 is an enlarged perspective view of one of the low-band radiating elements 300 of the base station antenna 100. The low-band radiating element 300 of FIG. 5 is configured to be substantially transparent to RF radiation in the operating frequency band of the high-band radiating elements 500.

As shown in FIG. 5, the low-band radiating element 300 includes a pair of feed stalks 302, and first and second dipole radiators 320-1, 320-2. The feed stalks 302 may each comprise a feed stalk printed circuit board 304 that has RF transmission lines 306 formed thereon. These RF transmission lines 306 carry RF signals between a feed board (not shown) and the dipole radiators 320. Each feed stalk printed circuit board 304 may further include a hook balun. A first of the feed stalk printed circuit boards 304-1 may include a lower vertical slit and the second of the feed stalk printed circuit boards 304-2 may include an upper vertical slit. These vertical slits allow the two feed stalk printed circuit boards 304 to be assembled together to form a vertically extending column that has generally x-shaped horizontal cross-sections. Lower portions of each feed stalk printed circuit board 304 may include projections 308 that are inserted through slits in a feed board to mount the radiating element 300 thereon. The RF transmission lines 306 on the respective feed stalk printed circuit boards 304 may center feed the dipole radiators 320-1, 320-2 via, for example, direct ohmic connections between the transmission lines 306 and the dipole radiators 320.

Each dipole radiator 320 may have a length that is between approximately 0.4 to 0.7 of an operating wavelength, where the "operating wavelength" refers to the wavelength corresponding to the center frequency of the operating frequency band of the radiating element 300. For example, if the low-band radiating elements 300 are designed as wideband radiating elements that are used to transmit and receive signals across the full 694-960 MHz frequency band, then the center frequency of the operating frequency band would be 827 MHz and the corresponding operating wavelength would be 36.25 cm.

The first and second dipole radiators 320-1, 320-2 may be formed on a dipole printed circuit board 310. The dipole printed circuit board 310 may include a front metallization layer 312, a dielectric layer 314 and a rear metallization layer 316 that are sequentially stacked. The dipole printed circuit board 310 may be substantially perpendicular to the feed stalk printed circuit boards 304 in some embodiments. The first dipole radiator 320-1 extends along a first axis 322-1 and the second dipole radiator 320-2 extends along a second axis 322-2 that is generally perpendicular to the first axis 322-1. Consequently, the first and second dipole radiators 320-1, 320-2 are arranged in the general shape of a cross. In the depicted embodiment, the first dipole radiator 320-1 is designed to transmit signals having a +45 degree polarization, while the second dipole radiator 320-2 is designed to transmit signals having a −45 degree polarization. The dipole printed circuit board 310 that includes the dipole radiators 320 may be mounted approximately 3/16 to 1/4 of an operating wavelength above the reflector 214 by the feed stalk printed circuit boards 304.

As can be seen in FIG. 5, each dipole radiator 320 is implemented as metal patterns on the dipole printed circuit board 310. Each metal pattern includes a plurality of widened sections 342 that are connected by narrowed trace sections 344. Each widened section 342 may have a respective length $L_1$ and a respective width $W_1$. The narrowed trace sections 344 may similarly have a respective length $L_2$ and a respective width $W_2$. The lengths $L_1$, $L_2$ are measured in a direction that is generally parallel to the direction of current flow, and the widths $W_1$, $W_2$ are measured in a direction that is generally perpendicular to the direction of current flow along the narrowed trace section 344. The narrowed trace sections 344 may be implemented as meandered conductive traces. This allows the widened trace sections 342 to be located in close proximity to each other so that the widened sections 342 will appear as a dipole at the low-band frequencies. The average width of each widened section 342 may be, for example, at least four times the average width of each narrowed trace section 344 in some embodiments.

Dipole radiators 320-1 and 320-2 may be designed to be substantially transparent to radiation emitted by the high-band radiating elements 500. In particular, the narrowed trace sections 344 may act as high impedance sections that are designed to interrupt currents in the high-band that could otherwise be induced on the low-band dipole radiators 320-1, 320-2. The narrowed trace sections 344 may be designed to create this high impedance for high-band currents without significantly impacting the ability of the low-band currents to flow on the dipole radiators 320-1, 320-2. By implementing the dipole radiators 320-1, 320-2 as a series of widened sections 342 that are connected by intervening narrowed trace sections 344, each dipole radiator 320 may act like a low-pass filter circuit. The smaller the length of each widened segment 342, the higher the cut off frequency of the low pass filter circuit. The length of each widened segment 342 and the electrical distance between adjacent widened segments 342 may be tuned so that the dipole radiators 320-1, 320-2 are substantially transparent to high-band RF radiation. As such, induced high-band currents on the low-band dipole radiators 320-1, 320-2 may be reduced, as may consequent disturbance to the antenna pattern of the high-band linear arrays 240.

The operating bandwidth of a dipole radiator is typically limited by the impedance match of the dipole radiator to the feed network. The impedance match varies with frequency, and most dipole radiators will provide a good impedance match to the feed network at the resonant frequency of the dipole radiator, and the impedance match will degrade as the frequency moves away from the resonant frequency. As the impedance match gets worse, the return loss of the dipole radiator increases. The bandwidth of the dipole radiator will be the bandwidth where an acceptable return loss is maintained, with an example value of an acceptable return loss being 12.5 dB.

Unfortunately, it may be difficult to impedance match the higher impedance narrowed trace sections 344 to the feed stalk. As a result, the bandwidth of the low-band radiating elements may be reduced as compared to low-band radiating elements that use conventional dipole radiators. This can be problematic if the bandwidth of the low-band radiating elements is less than the bandwidth of the low-band operating frequency band.

Pursuant to embodiments of the present invention, dipole radiators are provided that may have an extended bandwidth as compared to conventional dipole radiators. A typical conventional dipole radiator includes first and second arms that extend along a common axis. These dipole arms radiate together at a first resonant frequency. Pursuant to embodiments of the present invention, radiating elements are provided that include dipole radiators that each include at least two pairs of dipole arms, where each pair of dipole arms is configured to resonate at a different frequency. As explained below, this technique may be used to broaden the bandwidth of the low band radiating elements 300.

In particular, FIG. 6 is a plan view of upper and lower surfaces of a dipole printed circuit board 310 of the low-band radiating element 300 of FIG. 5. It should be noted that the depiction of the lower surface of printed circuit board 310 pictured on the right side of FIG. 6 is rotated 180° with respect to the depiction of the upper surface of printed circuit board 310 pictured on the left side of FIG. 6 so that the dipole arms 320-1, 320-2 have the same orientation in the two depictions. While not visible in FIG. 5, FIG. 6 shows that each dipole radiator 320 includes two pairs 330 of dipole arms 332. In particular, dipole radiator 320-1 includes a first pair 330-1 of dipole arms 332-1, 332-2 and a second pair 330-3 of dipole arms 332-3, 332-4. Similarly, dipole radiator 320-2 includes a first pair 330-2 of dipole arms 332-5, 332-6 and a second pair 330-4 of dipole arms 332-7, 332-8. Pairs 330-1, 330-2 of dipole arms 332-1, 332-2; 332-5, 332-6 are implemented in the first metallization layer 312 of dipole printed circuit board 310, and pairs 330-3, 330-4 of dipole arms 332-3, 332-4; 332-7, 332-8 are implemented in the second metallization layer 316 of dipole printed circuit board 310.

Dipole arms 332-1, 332-2 (the first pair 330-1) are center fed by a first RF transmission line 306. In the embodiment of FIGS. 5-6, the third pair 330-3 of dipole arms 332 is capacitively coupled to the first pair 330-1 of dipole arms 332 and there is no direct galvanic connection between the first pair 330-1 of dipole arms 332 and the third pair 330-3 of dipole arms 332. The first and third pairs 330-1, 330-3 of dipole arms 332 radiate together to transmit/receive RF signals at a first polarization (here a −45° polarization). Similarly, dipole arms 332-5, 332-6 (the second pair 330-2) are center fed by a second RF transmission line 306, and the fourth pair 330-4 of dipole arms 332-7, 332-8 is capacitively coupled to the second pair 330-2 of dipole arms 332-5, 332-6. The second and fourth pairs 330-2, 330-4 of dipole arms 332 radiate together to transmit/receive RF signals at a second polarization (here a +45° polarization).

By including two pairs 330 of dipole arms 332 that are configured to resonate at different frequencies in each dipole radiator 320, the operating bandwidth of each dipole radiator 320 may be increased. For example, the dipole arms 332-1, 332-2 in the first pair 330-1 of dipole arms 332 have a different electrical length than the dipole arms 332-3, 332-4 in the third pair 330-3 of dipole arms 332. In the depicted embodiment, the dipole arms 332-1, 332-2 in the first pair 330-1 of dipole arms 332 have a longer electrical length than the dipole arms 332-3, 332-4 in the third pair 330-3 of dipole arms 332. As a result, the first pair 330-1 of dipole arms 332 will resonate at a first resonant frequency and the third pair 330-3 of dipole arms 332 will resonate at a third resonant frequency that is higher than the first resonant frequency. Dipole radiator 320-2 is constructed in the same fashion with the second and fourth pairs 330-2, 330-4 of dipole arms 332 configured so that the second pair 330-2 of dipole arms will resonate at a second resonant frequency and the fourth pair 330-4 of dipole arms will resonate at a fourth resonant frequency that is higher than the second resonant frequency. In some embodiments, the first and second resonant frequencies may be in the operating frequency band for the radiating elements 300 and may be below a center frequency $f_c$ of that operating frequency band, while the third and fourth resonant frequencies may be in the operating frequency band for the radiating elements 300 and may be above the center frequency $f_c$ of the operating frequency band.

While not wishing to be bound by any particular technical theory of operation, it is believed that since the first pair 330-1 of dipole arms 332 resonate at a frequency below the center frequency $f_c$ of the operating frequency band of the dipole radiator 320-1, the range of frequencies where the first pair 330-1 of dipole arms 332 exhibit an acceptable impedance match may be extended to lower frequencies as compared to a pair of dipole arms that resonate together at the center frequency $f_c$ of the operating frequency band. Likewise, since the third pair 330-3 of dipole arms 332 resonate at a frequency above the center frequency $f_c$ of the operating frequency band of the dipole radiator 320-1, the range of frequencies where the third pair 330-3 of dipole arms 332 exhibit an acceptable impedance match may be extended to higher frequencies as compared to a pair of dipole arms that resonate together at the center frequency $f_c$ of the operating frequency band. When comparing the double-resonance dipole radiators according to embodiments of the present invention to a conventional single-resonance dipole radiator, it has been found that the real part of the impedance may be lower and the imaginary part of the impedance may have a flatter slope, both of which may help increase the bandwidth of the dipole radiator. Thus, the net result is that the "double-resonant" dipole radiator design of dipole radiator 320-1 (and similarly for dipole radiator 320-2) extends the frequency range where an acceptable impedance match may be achieved.

In the particular embodiment depicted in FIGS. 5-6, each dipole arm 332 in the first and second pairs 330-1, 330-2 of dipole arms 332 includes first and second spaced-apart conductive segments 340-1, 340-2 that together form a generally oval shape. The first conductive segment 340-1 may form half of the generally oval shape and the second conductive segment 340-2 may form the other half of the generally oval shape. The portions of the conductive segments 340-1, 340-2 at the end of each dipole arm 332 in the first and second pairs 330-1, 330-2 that is closest to the center of each dipole radiator 320 may have straight outer edges as opposed to curved configuration of a true oval. Likewise, the portions of the conductive segments 340-1, 340-2 at the distal end of each dipole arm 332 in the first and second pairs 330-1, 330-2 may also have straight or nearly straight outer edges. It will be appreciated that such approximations of an oval are considered to have a generally oval shape for purposes of this disclosure.

The dipole arms 332 in the third pair 330-3 of dipole arms 332 directly underlie the dipole arms 332 in the first pair 330-1 of dipole arms 332, and the dipole arms 332 in the fourth pair 330-4 of dipole arms 332 directly underlie the dipole arms 332 in the second pair 330-2 of dipole arms 332. In the embodiment of FIGS. 5-6, each dipole arm 332 in the third pair 330-3 of dipole arms 332 is formed to have the exact same shape as the overlying dipole arm 332 in the first pair 330-1 of dipole arms 332, and each dipole arm 332 in the fourth pair 330-4 of dipole arms 332 is formed to have the exact same shape as the overlying dipole arm 332 in the second pair 330-2 of dipole arms 332, except that in each dipole arm 332 in the third and fourth pairs 330-3, 330-4 of dipole arms 332, the inner portion of the dipole arm 332 is omitted. As a result, the electrical length of each dipole arm 332 in the third and fourth pairs 330-3, 330-4 of dipole arms 332 is shorter than the electrical length of the dipole arms 332 in the first and second pairs 330-1, 330-2 of dipole arms 332. Consequently, the dipole arms 332 in the third and fourth pairs 330-3, 330-4 of dipole arms 332 do not form full generally oval shapes, but instead are formed as truncated generally oval shapes. Herein the dipole arms 332 in the third and fourth pairs 330-3, 330-4 of dipole arms 332 may be referred to as the "rear" dipole arms 332 and the dipole arms 332 in the first and second pairs 330-1, 330-2 of dipole arms 332 may be referred to as the "front" dipole arms 332 since the dipole arms 332 in the first and second pairs 330-1, 330-2 of dipole arms 332 will be forward of the dipole arms 332 in the third and fourth pairs 330-3, 330-4 of dipole arms 332 when the base station antenna 100 is mounted for use.

While the pairs 330 of dipole arms 332 used in dipole radiators 320 have front and rear dipole arms 332 that have exactly the same design, except that the rear dipole arms 332 have truncated generally oval shapes as opposed to generally oval shapes, it will be appreciated that embodiments of the present invention are not limited thereto. Thus, for example, in other embodiments, the rear dipole arms 332 may have generally oval shapes where the oval is smaller than the corresponding oval for the front dipole arms 332. It will likewise be appreciated that any suitable dipole arm design may be used, including dipole arms that are generally linearly disposed as opposed to dipole arms that have a generally oval shape. An example of a dipole radiator that includes such generally linear dipoles is discussed below.

Figure 7:
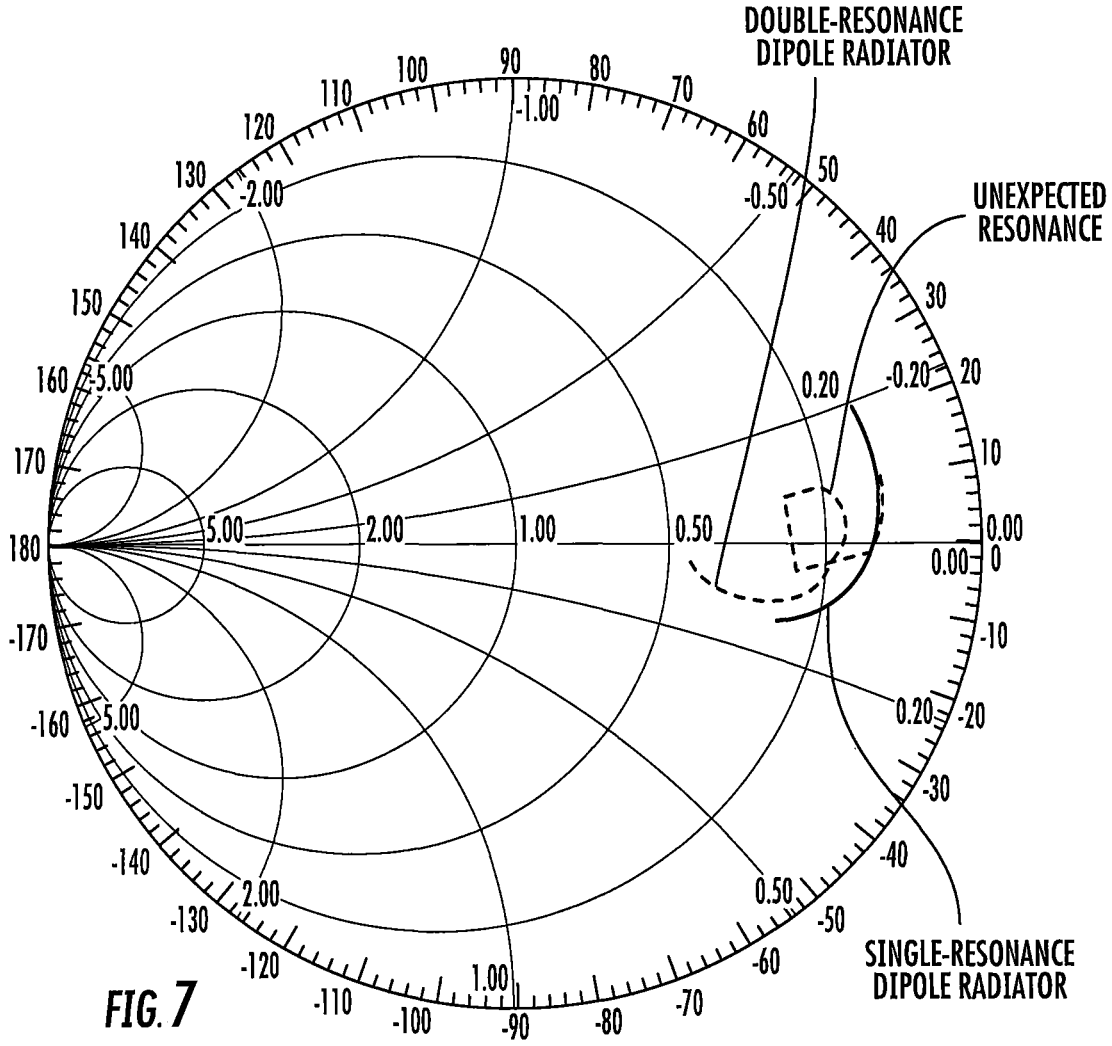
FIG. 7 is a Smith chart illustrating the performance of the double resonator dipole radiators included in the low-band radiating elements of the base station antenna of FIGS. 1-4 as compared to the performance of single resonator dipole radiators.

FIG. 7 is a Smith chart illustrating the performance of the double-resonance dipole radiators 320 included in the low-band radiating elements of the base station antenna of FIGS. 1-4 as compared to the performance of a single-resonance dipole radiators having the exact same dipole arm design. As shown in FIG. 7, the double-resonance dipole radiators 320 exhibit a lower Q factor than the corresponding single-resonance dipole radiators, which means that the double-resonance dipole radiators 320 will have a wider operating bandwidth and be easier to impedance match.

Figure 8:
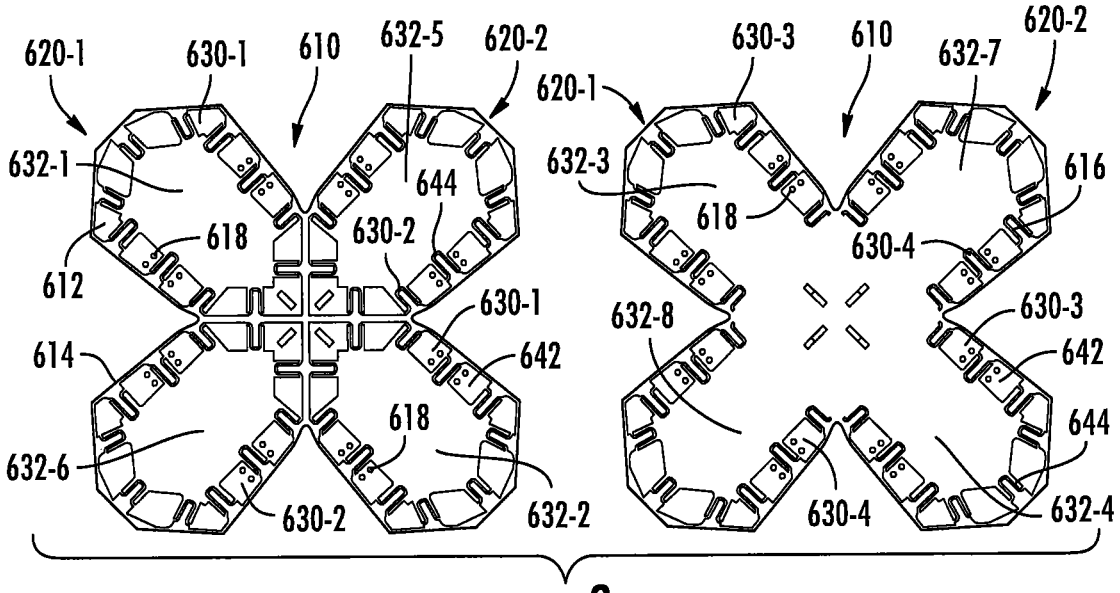
FIG. 8 shows front and back views of another dipole printed circuit board that could be used on the low-band radiating elements of the base station antenna of FIGS. 1-4.

However, as can also be seen in FIG. 7, the double-resonance dipole radiators 320 generate an unexpected resonance in the operating frequency band of the radiating element 300 (which in this specific example if the 694-960 MHz frequency band). This unexpected resonance is shown on the Smith Chart by the loop that appears in the response. This unexpected resonance may degrade the shape of the antenna beam. Pursuant to further embodiments of the present invention, it has been found that by galvanically connecting the front and rear dipole arms of the dipole radiators the unexpected resonance may be reduced or eliminated. FIG. 8 is a front and back view of a dipole printed circuit board 610 according to further embodiments of the present invention that uses this approach to remove the unexpected resonance. The dipole printed circuit board 610 may be used, for example, in place of the dipole printed circuit board 310 to form the low-band radiating elements 600 that may be used in place of the low-band radiating elements 300 in base station antenna of FIGS. 1-4.

As shown in FIG. 8, the dipole printed circuit board 610 includes two dipole radiators 620-1, 620-2 formed thereon. Each dipole radiator 620 comprises two pairs 630 of dipole arms 632. The only difference between dipole radiators 320 (described above) and dipole radiators 620 is that each dipole radiator 620 includes a galvanic connection between the front and rear pairs 630 of dipole arms 632, which is implemented using plated through holes 618 that extend through the dielectric layer 614 of the dipole printed circuit board 610. As shown in FIG. 8, the plated through holes 618 extend between widened segments 644 of each front dipole arm 632 and corresponding widened segments 644 of each rear dipole arm 632.

Figure 9:
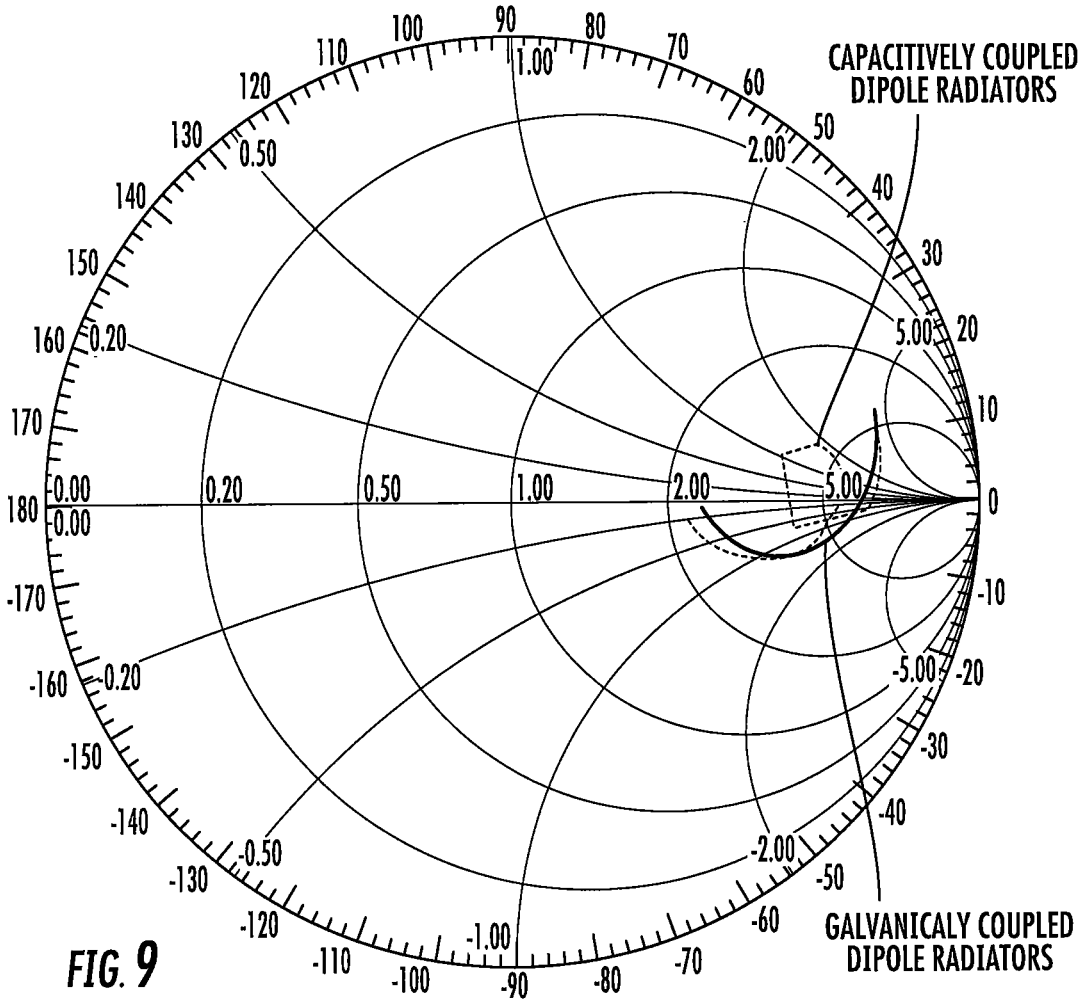
FIG. 9 is a Smith chart illustrating the performance of the double resonator dipole radiators of FIG. 8 as compared to the performance of the double resonator dipole radiators of FIG. 6.

While not intending to be bound by any particular theory of operation, it is believed that the unexpected resonance that can be seen in FIG. 7 arises due to an interaction between the capacitive coupling of the front and rear dipole arms 332 with the inductor-capacitor ("L-C") circuits created in each dipole arm 332 by the widened segments 342 and the narrow trace segments 344. Through simulation or testing of actual prototypes it is possible to determine where the current flow on the dipole arms 332 exhibits unusual behavior that generates the unexpected resonance. By adding the plated through holes 618 in the vicinity of identified locations, the current flow can be balanced in the double-resonance dipole radiators 620 and the unexpected resonance may be reduced or eliminated. This can be seen in FIG. 9, which is a Smith chart illustrating the performance of the double-resonance dipole radiators 620 of FIG. 8 as compared to the performance of the double-resonance dipole radiators 320 of FIG. 6.

Figure 13:
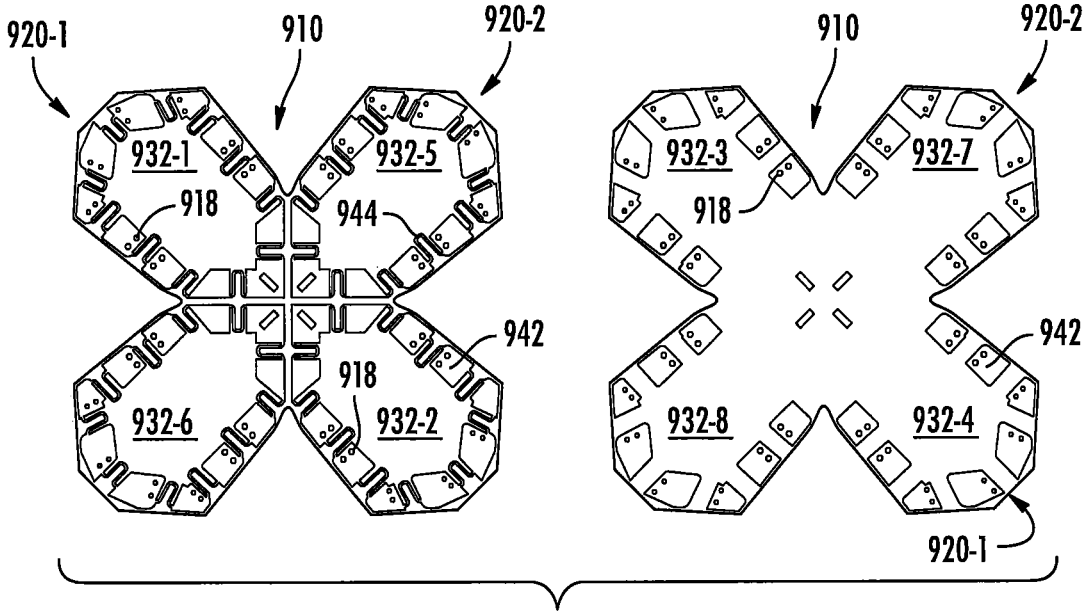
FIG. 13 shows front and back views of another dipole printed circuit board that could be used on the low-band radiating elements of the base station antenna of FIGS. 1-4.

When designing the multi-resonance dipole radiating elements according to embodiments of the present invention such as, for example, the low-band radiating elements 300, it may be necessary to tune the L-C circuits created in each dipole arm 332 by the widened segments 342 and the narrow trace segments 344. Tuning the multi-resonance dipole radiating elements according to embodiments of the present invention may, however, be more challenging than tuning single resonance radiating elements. It has been discovered that the inclusion of the narrow trace segments on both the front and rear pairs of dipole arms may make tuning the radiating elements more difficult. Accordingly, pursuant to further embodiments of the present invention, multi-resonance dipole radiating elements are provided in which the narrow trace segments are only provided on one of the front or rear dipole arms of each pair of dipole arms. FIG. 13 provides front and back views of a dipole printed circuit board 910 that could be used on the low-band radiating elements of the base station antenna of FIGS. 1-4 that has such a design.

Figure 14:
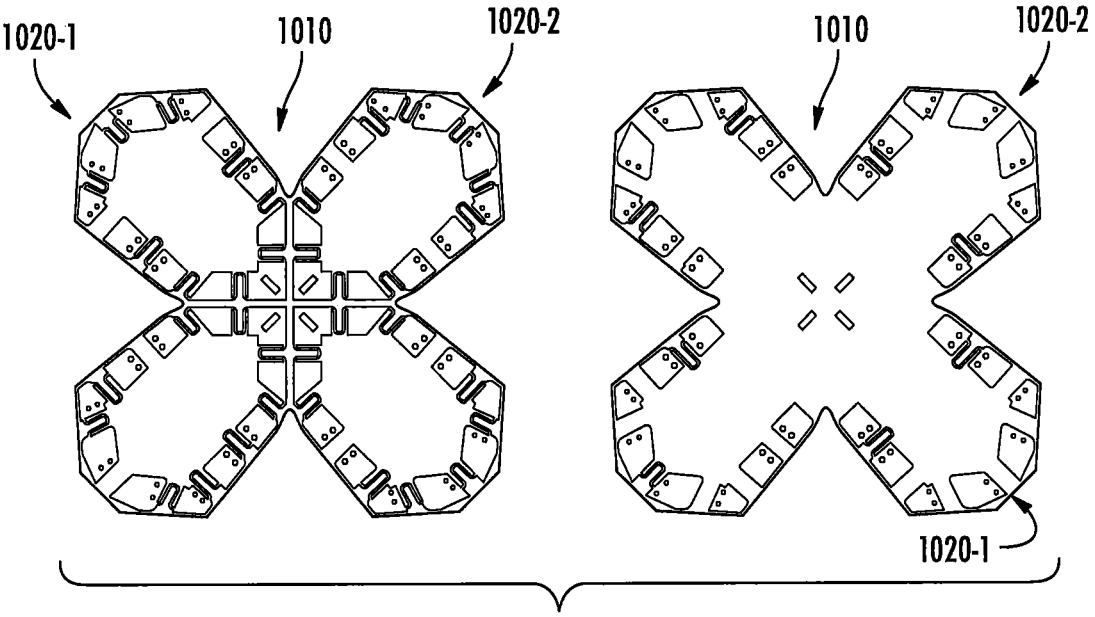
FIG. 14 shows front and back views of a modified version of the dipole printed circuit board of FIG. 13.

As shown in FIG. 13, the dipole printed circuit board 910 includes two dipole radiators 920-1, 920-2. Each dipole radiator 920 comprises two pairs of dipole arms 932. The only difference between the dipole radiators 620 that are described above with reference to FIG. 8 and the dipole radiators 920 are that (1) the dipole radiators 920 includes a greater number of galvanic connections in the form of plated through holes 918 that extend through the dielectric layer 914 of the dipole printed circuit board 910 such that every widened segment 642 of each front dipole arm 932 (as opposed to just a couple of widened segments 942) is electrically connected to a respective corresponding widened segment 942 of each rear dipole arm 932 and (2) the narrow trace segments 944 are omitted from each rear dipole arm 932. While in the embodiment of FIG. 13 the narrow trace segments 944 are only provided on the front surface of the printed circuit board 910, it will be appreciated that in other embodiments the narrow trace segments 944 could alternatively only be provided on the rear surface of the printed circuit board 910. Likewise, in still other embodiments, the narrow trace segments may be provided on both the front and rear surfaces of the printed circuit board, but only one narrow trace segment is provided to connect two pairs of overlapping widened segments (where a pair of overlapping widened segments refers to a widened segment on the front of the printed circuit board that is directly opposite a widened segment on the rear of the printed circuit board). FIG. 14 illustrates a dipole printed circuit board 1010 that has dipole radiators 1020-1, 1020-2 that have such a design.

Figure 10:
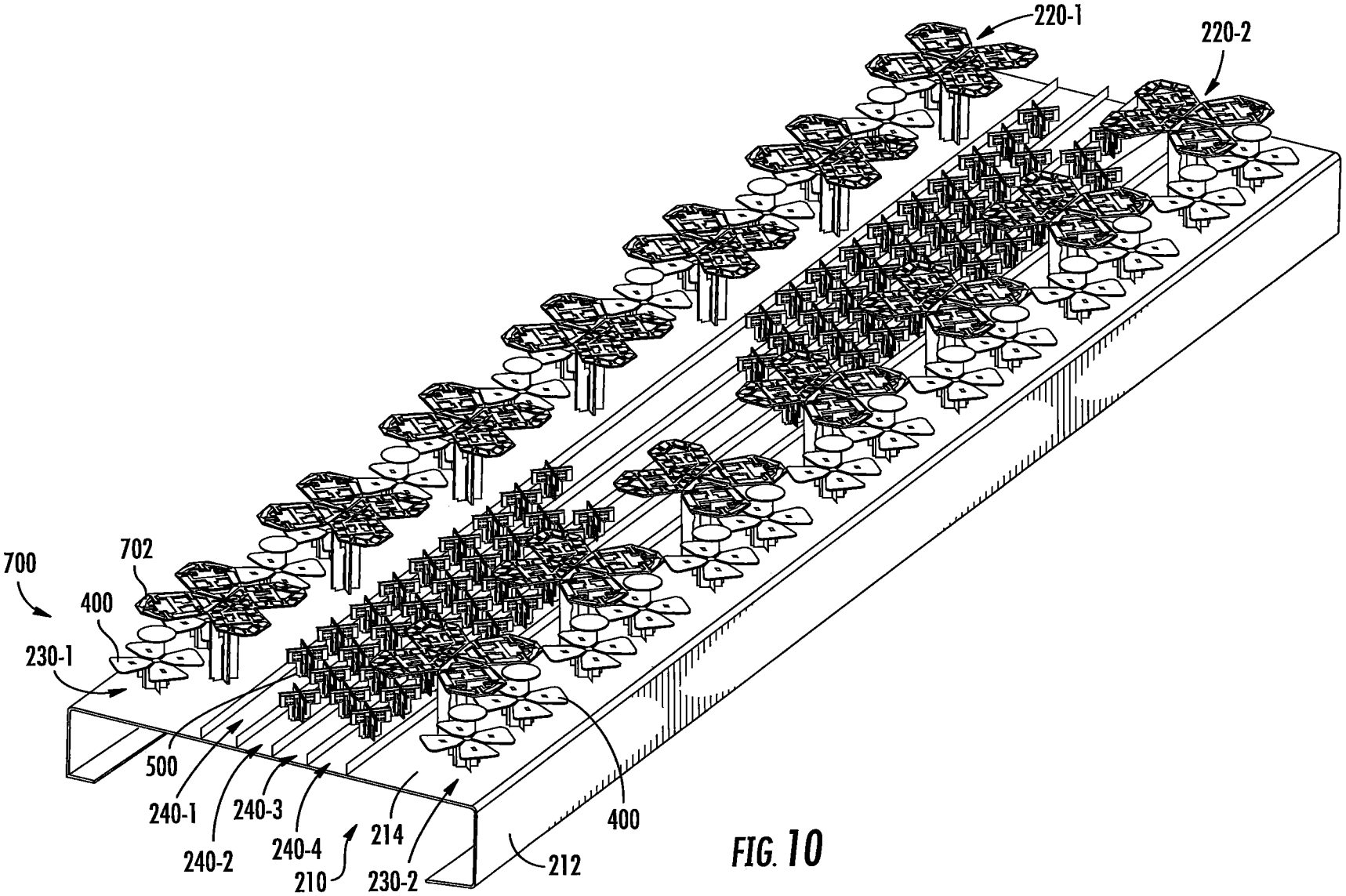
FIG. 10 is a front view of the base station antenna according to further embodiments of the present invention with the radome removed.
Figure 11:
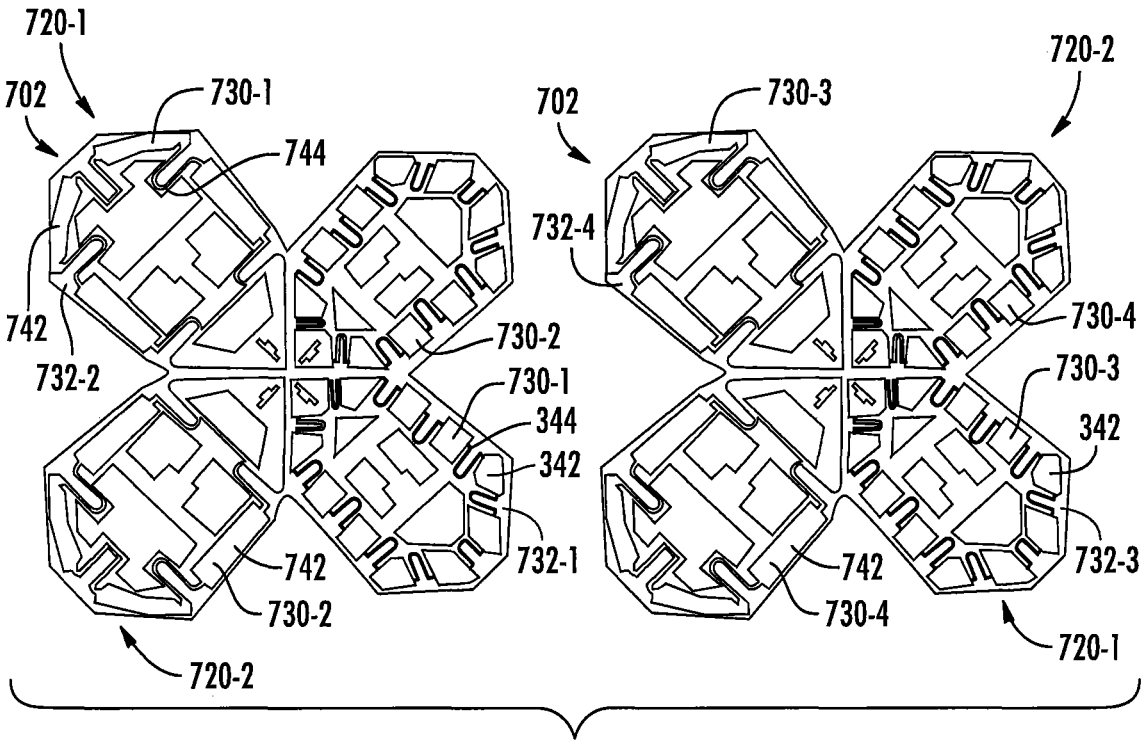
FIG. 11 shows front and back views of the dipole printed circuit board of one of the low-band radiating elements of the base station antenna of FIG. 10.

FIG. 10 is a front view of the base station antenna 700 according to further embodiments of the present invention with the radome removed. FIG. 11 is a front and back view of the dipole printed circuit board 710 of one of the low-band radiating elements of the base station antenna 700 of FIG. 10.

Chinese Patent Application Serial No. 201810971466.4, filed Aug. 24, 2018, discloses a base station antenna that includes two linear arrays of low-band radiating elements, two linear arrays of mid-band radiating elements, and four linear arrays of high-band radiating elements, that are arranged in the manner shown in FIGS. 2-4 of the present application. Chinese Patent Application Serial No. 201810971466.4 teaches that when a low-band linear array is placed between and in very close proximity to a mid-band linear array and a high-band linear array, the use of unbalanced low-band radiating elements may be desirable. In particular, in order to reduce from both the mid-band linear array and the high-band linear array onto the low-band radiating elements, the low-band radiating elements may be designed to have two dipole arms that are substantially transparent to radiation emitted by the mid-band radiating elements, and dipole arms that are designed to be substantially transparent to radiation emitted by the high-band radiating elements.

For example, as shown in FIG. 11, base station antenna 700 may be identical to base station antenna 100, except that the low-band radiating elements 300 of base station antenna 100 are replaced with low-band radiating elements 702. Each low-band radiating element 702 includes two dipole radiators 720-1, 720-2 that are substantially "transparent" on one side to radiation emitted by the high-band radiating elements 500, and on the other side to radiation emitted by the mid-band radiating elements 400.

Dipole radiator 720-1 includes a first pair 730-1 of dipole arms 732-1, 732-2 and a second pair 730-2 of dipole arms 732-3, 732-4. The first dipole arm 732-1 in pair 730-1 may be identical to one of the dipole arms in pair 330-1, and the first dipole arm 732-3 in pair 730-2 may be identical to one of the dipole arms in pair 330-2, and hence further description thereof will be omitted. Dipole arms 732-1, 732-3 may each project toward the high-band radiating elements 500. The second dipole arm 732-2 in pair 730-1 and the second dipole arm 732-4 in pair 730-2 may, however, differ from the dipole arms 332 in pairs 330-1, 330-2 in that dipole arms 732-2 and 732-4 may have widened sections 742 and narrowed trace sections 744 that are sized and positioned to render the dipole arms 732-2, 732-4 substantially transparent to RF energy emitted by the mid-band radiating elements 400 as opposed to RF energy emitted by the high-band radiating elements 500, since dipole arms 732-2, 732-4 each project toward the mid-band radiating elements 400. As can best be seen in FIG. 11, each widened section 742 is longer than the corresponding widened sections 342. As can also be seen in FIG. 11, dipole arms 732-1, 732-3 may have at least 50% more widened sections 342 as compared to the number of widened sections 742 includes in dipole arms 732-2, 732-4. Dipole radiator 720-2 may have the exact same design as dipole radiator 720-1, except that the two dipole radiators 720-1, 720-2 are rotated 90° with respect to each other. Notably, each dipole radiator 720 is implemented as a double-resonance dipole radiator that includes two pairs 730 of dipole arms 732. While not shown in FIG. 11, plated through holes may be provided that physically and electrically connect each front dipole arm to the rear dipole arm that is mounted behind it. It will also be appreciated that the plated through holes (or alternative galvanic connections) may be omitted in other embodiments.

Figure 12:
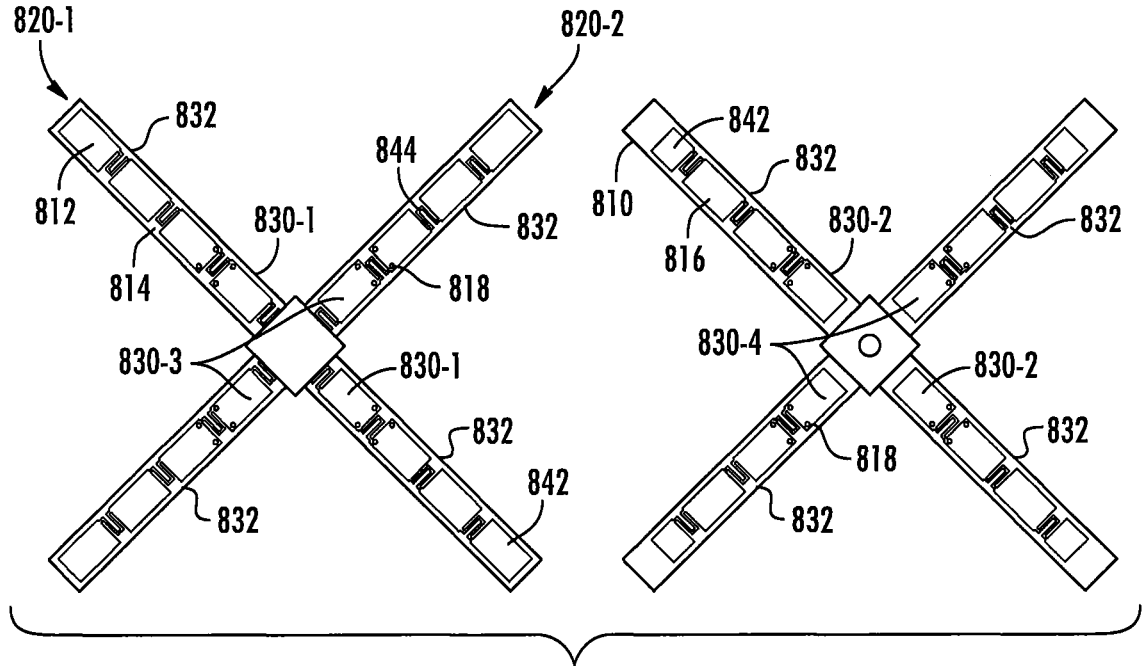
FIG. 12 shows front and back views of a dipole printed circuit board for a radiating element according to further embodiments of the present invention.

FIG. 12 shows front and back views of a dipole printed circuit board 810 for a radiating element 800 according to further embodiments of the present invention. The printed circuit board 810 may include a front metallization layer 812, a dielectric layer 814 and a rear metallization layer 816. The radiating element 800 may have feed stalks that are similar or identical to the feed stalks 302 for radiating element 300. The radiating elements 800 may be used in place of the radiating elements 300 in base station antenna 100.

As shown in FIG. 12, the radiating element 800 includes first and second dipole radiators 820-1, 820-2. Dipole radiator 820-1 includes a first pair 830-1 of dipole arms 832 that are formed in the first metallization layer 812. Dipole radiator 820-1 includes a second pair 830-2 of dipole arms 832 that are formed in the second metallization layer 816. Similarly, dipole radiator 820-2 includes a third pair 830-3 of dipole arms 832 that are formed in the first metallization layer 812 and a fourth pair 830-4 of dipole arms 832 that are formed in the second metallization layer 816. Each dipole arm 832 includes a plurality of widened sections 842 that are connected by narrowed trace sections 844. However, in contrast to the oval dipole arms discussed above, the dipole arms 832 are relatively straight. As shown in FIG. 12, the dipole arms 832 in the first and third pairs 830-1, 830-3 of dipole arms 832 are longer than the dipole arms 832 in the second and fourth pairs 830-2, 830-4 of dipole arms 832. Consequently, the first and third pairs 830-1, 830-3 of dipole arms 832 will each resonate at a first resonant frequency and the second and fourth pairs 830-2, 830-4 of dipole arms 832 will each resonate at a second resonant frequency that is higher than the first resonant frequency. FIG. 12 is provided to make clear that the multiple-resonance techniques disclosed herein may be implemented with respect to any type of dipole radiator, and not just with dipole radiators that have generally oval shaped dipole arms. In the particular embodiment shown in FIG. 12, plated through holes 818 are provided that physically and electrically connect each front dipole arm to the rear dipole arm that is mounted behind it. It will be appreciated that in other embodiments, more or fewer plated through holes 818 may be provided and/or that the locations of the plated through holes 818 may be changed. It will also be appreciated that the plated through holes 818 (or alternative galvanic connections) may be omitted in other embodiments.

While the above embodiments describe implementations in which the pairs of dipole arms are implemented on different metallization layers of a printed circuit board, it will be appreciated that the present invention is not limited thereto. For example, in other embodiments, stamped sheet metal of other metal dipoles may be used that are separated by an insulation layer such as a plastic layer or even air. For example, U.S. Provisional Patent Application Ser. No. 62/528,611 ("the '611 application"), filed Jul. 5, 2017, which is incorporated herein by reference, discloses techniques for forming radiating elements that have sheet metal on dielectric dipole radiators that may be used in place of printed circuit board based dipole radiators. The techniques disclosed in the '611 application could be used to form multi-resonance dipole radiators that do not have dipole printed circuit boards. For example, FIGS. 8A-8B of the '611 application picture a pair of cross-dipole radiators that are formed by adhering four sheet metal dipole arms to the top side of a dielectric substrate. By adhering another four dipole arms to the bottom side of the dielectric substrate, any of the above-disclosed double-resonance radiating elements could be formed without using a dipole printed circuit board. Thus, it will be appreciated that embodiments of the present invention are not limited to printed circuit board implementations.

Additionally, while the discussion above focuses primarily on double-resonance radiating elements, it will be appreciated that the techniques described above can be extended to provide radiating elements with dipole radiators that resonate at three (or more) different resonance frequencies. One convenient way of implementing, for example, a triple-resonance radiating element would be to provide a dipole printed circuit board having three metallization layers, and implementing pairs of dipole arms having different electrical lengths on each of the metallization layers.

While the dipole printed circuit board, when used, will often be implemented as a single printed circuit board, it will be appreciated that embodiments of the present invention are not limited thereto. Thus, it will be understood that multiple printed circuit boards may be used to implement the dipole printed circuit board. For example, in the radiating element 800 shown in FIG. 12, it may be convenient in some cases to implement each front dipole arm (and its corresponding rear dipole arm) on its own printed circuit board. Thus, the dipole printed circuit board 810 of FIG. 12 may actually be implemented using four separate printed circuit boards in some embodiments.

The multi-resonance dipole radiators according to embodiments of the present invention can significantly increase the operating bandwidth as compared to a single-resonance dipole radiators. For example, modelling indicates that the double-resonance dipole radiators included in the radiating elements of FIG. 8 may have a 26% wider bandwidth than an otherwise identical single-resonance radiating element, where the bandwidth was based on a return loss specification of −12.5 dB.

While the example embodiments described above have low-band radiating elements that are designed to have multi-resonance dipole radiators, it will be appreciated that embodiments of the present invention are not limited thereto. For example, in other embodiments, mid-band radiating elements may be provided that have multi-resonance dipole radiators.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radiating element, comprising:

a first dipole radiator that extends along a first axis, the first dipole radiator including first and second dipole arms that are configured to resonate at a first frequency and third and fourth dipole arms that are configured to resonate at a second frequency that is different than the first frequency, wherein each of the first and second dipole arms comprises a plurality of conductive segments that are on a first side of a printed circuit board and each of the third and fourth dipole arms comprises a plurality of conductive segments that are on a second side of the printed circuit board, wherein at least two adjacent ones of the conductive segments in the third dipole arm are electrically connected to each other by a first meandered conductive trace that is on the first side of the printed circuit board.

2. The radiating element of claim 1, wherein the first frequency and the second frequency are within an operating frequency band of the radiating element.

3. The radiating element of claim 2, wherein the first frequency is below a center frequency of the operating frequency band of the radiating element and the second frequency is above the center frequency of the operating frequency band of the radiating element.

4. The radiating element of claim 1, wherein the conductive segments of the first dipole are interconnected by a first plurality of meandered conductive traces that are on the first side of the printed circuit board, the plurality of meandered conductive traces including the first meandered conductive trace, and the conductive segments of the second dipole are interconnected by a second plurality of meandered conductive traces that are on the first side of the printed circuit board.

5. The radiating element of claim 4, wherein the conductive segments of the third dipole are not interconnected by any meandered conductive traces that are on the second side of the printed circuit board.

6. A radiating element, comprising:

a first dipole radiator that extends along a first axis, the first dipole radiator including a first pair of dipole arms that are configured to resonate at a first frequency and a second pair of dipole arms that are configured to resonate at a second frequency that is different than the first frequency, wherein each dipole arm in the first pair of dipole arms comprises a plurality of widened sections that are connected by intervening narrowed sections, and wherein each of the dipole arms in the first pair of dipole arms includes more widened sections than do each of the dipole arms in the second pair of dipole arms.

7. The radiating element of claim 6, wherein the radiating element is configured to operate over a continuous operating frequency band, and the first frequency and the second frequency are both part of the continuous operating frequency band.

8. A radiating element, comprising:

a feed stalk printed circuit board; and a dipole printed circuit board mounted on the feed stalk printed circuit board, the dipole printed circuit board including a first dipole radiator that includes a first pair of dipole arms that are configured to resonate at a first frequency and a second pair of dipole arms that are configured to resonate at a second frequency that is different than the first frequency, wherein the first pair of dipole arms comprises a metal pattern on a first layer of the dipole printed circuit board and the second pair of dipole arms comprises a metal pattern on a second layer of the dipole printed circuit board, wherein each dipole arm in the first pair of dipole arms comprises a plurality of spaced apart conductive segments that define a full loop, and each dipole arm in the second pair of dipole arms comprises a plurality of spaced apart conductive segments that only define a portion of a loop.

9. The radiating element of claim 8, the dipole printed circuit board further including a second dipole radiator that includes a third pair of dipole arms that are configured to resonate at the first frequency and a fourth pair of dipole arms that are configured to resonate at the second frequency, and wherein the third pair of dipole arms comprises part of the metal pattern on the first layer of the dipole printed circuit board and the fourth pair of dipole arms comprises part of the metal pattern on the second layer of the dipole printed circuit board.

10. The radiating element of claim 8, wherein the first dipole radiator further comprises a third pair of dipole arms that are configured to resonate at a third frequency that is different than the first and second frequencies.

11. The radiating element of claim 8 mounted on a base station antenna as part of a first linear array of radiating elements that are configured to transmit RF signals in a first operating frequency band, the base station antenna further comprising a second linear array of radiating elements that are configured to transmit RF signals in a second operating frequency band.

12. The radiating element of claim 11, wherein at least one of the dipole arms in the first pair of dipole arms horizontally overlaps one of the radiating elements in the second linear array of radiating elements.

13. A radiating element, comprising:

a first dipole radiator that extends along a first axis, the first dipole radiator including first and second dipole arms that each have a first electrical length and third and fourth dipole arms that each have a second electrical length that is different than the first electrical length, the first and second dipole arms overlap the third and fourth dipole arms and separated from the third and fourth dipole arms by a dielectric layer, wherein the first dipole is galvanically coupled to the third dipole arm through a plated through hole that galvanically connects a first conductive segment of the first dipole arm to a first conductive segment of the third dipole arm, wherein the first conductive segment is interposed between a pair of meandered conductive traces that are part of the first dipole arm.

14. The radiating element of claim 13, wherein the first pair of dipole arms are configured to resonate at a first frequency and the second pair of dipole arms are configured to resonate at a second frequency that is different than the first frequency, the first and second frequencies being within an operating frequency band of the radiating element.

* * * * *